United States Patent [19]

Stork

[11] Patent Number: 4,813,355

[45] Date of Patent: Mar. 21, 1989

[54] HAND-HELD PRINTING AND LABELING DEVICE

[75] Inventor: Edward S. Stork, Dayton, Ohio

[73] Assignee: Monarch Marking Systems, Inc., Dayton, Ohio

[21] Appl. No.: 102,966

[22] Filed: Sep. 30, 1987

[51] Int. Cl.[4] ..... B41K 1/36; B65C 9/18

[52] U.S. Cl. ..... 101/288; 226/115; 226/110; 156/584; 156/384; 156/DIG. 25; 101/329

[58] Field of Search ..... 226/109, 110, 115, 127; 101/288, 287, 291, 292, 293, 21, 27, 333, 334, 329; 156/384, 584, DIG. 24

[56] References Cited

U.S. PATENT DOCUMENTS

| | | | |
|---|---|---|---|
| 2,482,542 | 9/1949 | Hanrahan et al. | 101/288 |
| 3,119,328 | 1/1964 | Pittman et al. | 101/288 |
| 3,301,370 | 1/1967 | Miller | 101/21 |
| 3,343,485 | 9/1967 | Loeffler | 101/288 |
| 3,389,772 | 6/1968 | Sjogren et al. | 101/288 |
| 3,408,931 | 11/1968 | Austin | 101/318 |
| 3,490,365 | 1/1970 | Roche | 101/288 |
| 3,817,177 | 6/1974 | VanArnan et al. | 101/288 |
| 4,088,256 | 5/1978 | Potma et al. | 226/115 |
| 4,116,747 | 9/1978 | Hamisch, Jr. | 101/288 |
| 4,301,729 | 11/1981 | Fujita | 101/291 |
| 4,382,835 | 5/1983 | Sato et al. | 101/288 |
| 4,432,030 | 2/1984 | Jue | 101/288 |
| 4,444,611 | 4/1984 | Becker | 101/288 |

FOREIGN PATENT DOCUMENTS

| | | | |
|---|---|---|---|
| 191495 | 8/1986 | European Pat. Off. | 400/88 |
| 147370 | 8/1985 | Japan | 101/288 |

*Primary Examiner*—William Pieprz

*Attorney, Agent, or Firm*—Joseph J. Grass

[57] ABSTRACT

There is disclosed a hand-held device for optionally printing and dispensing a web of tags or pressure sensitive labels, or printing on pressure sensitive labels and applying the printed labels to merchandise. Also disclosed are composite webs of pressure sensitive labels and method of using such webs.

2 Claims, 4 Drawing Sheets

HAND-HELD PRINTING AND LABELING DEVICE

BACKGROUND OF THE INVENTION

1. Field of the Invention

This invention relates to the field of printing and labeling devices.

2. Brief Description of the Prior Art

The following U.S. patents are made of record: U.S. Pat. Nos. 3,343,485; 3,408,931; 3,408,931; 3,490,365; 4,116,747; and 4,382,835. In the device of the type disclosed in U.S. Pat. No. 4,382,835 optionally, in one use webs of tags or labels can be printed upon and dispensed, and in another use labels can be printed, delaminated and applied to merchandise.

SUMMARY OF THE INVENTION

According to the invention there is disclosed an improved hand-held device which can be used either to print and dispense a web of tags or pressure sensitive labels, or to print and apply pressure sensitive labels to merchandise.

A specific embodiment of the device is of simple construction and yet uses one of two different toothed drivers for advancing a web to be printed upon. In the event a web of tags or pressure sensitive labels is to be printed, the one toothed driver is used to advance the web to a printing position. In the event pressure sensitive labels are to be printed and applied to merchandise, the other toothed driver is used.

In one specific embodiment, a feed finger is mounted on a print head and moves the web of tags or labels to a printing position between the print head and a platen. The feed finger moves the web toward the printing position, and the print head prints at the end of the movement of the print head and the feed finger which it carries. It is preferred that the other toothed driver be a toothed feed wheel disposed downstream of the print head.

Other features of the invention will be readily apparent to those skilled in the art.

DETAILED DESCRIPTION OF THE PREFERRED EMBODIMENTS

Figure 1:
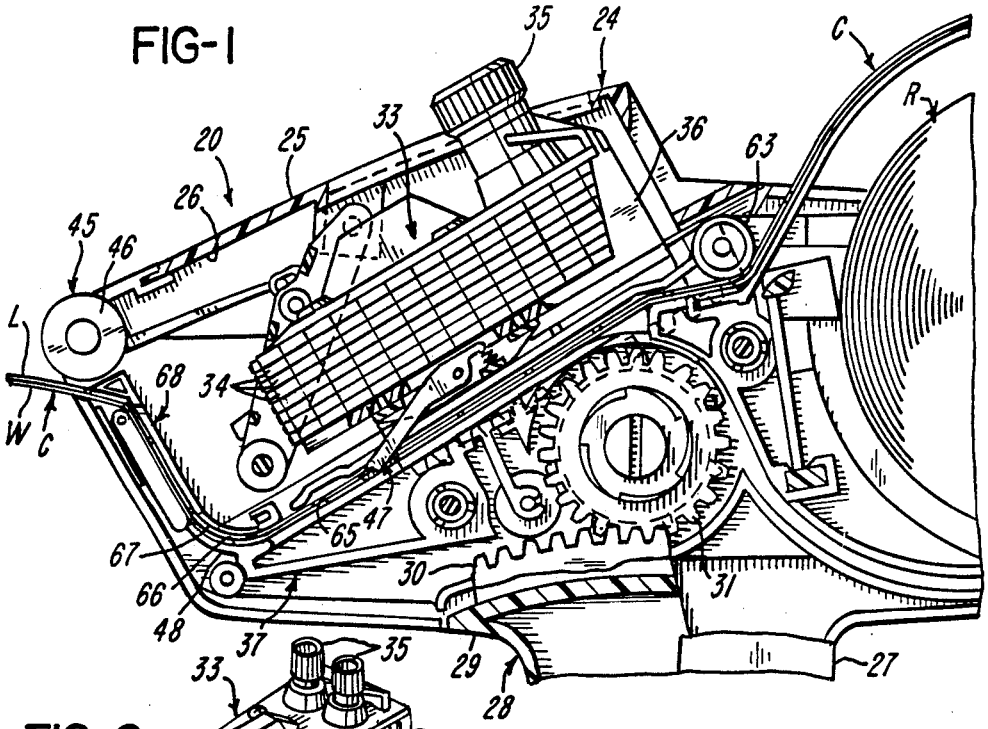
FIG. 1 is a side elevational fragmentary view of a hand-held labeler in accordance with the invention, showing labels dispensed on a carrier web.

With reference to FIG. 1, there is shown a significant portion of a hand-held device generally indicated at 20 for printing and dispensing record members such as labels L on a carrier web W or alternatively for printing, delaminating and applying labels L to merchandise. The carrier web W and the labels L releasably adhered thereto constitute a composite web C. The composite web C is initially wound into a label supply roll R mounted on the device 20. Examples of composite label webs C are shown in detail and are indicated respectively at 21, 22 and 23 in FIGS. 8, 9 and 10.

The device 20 is identical to the labeler disclosed in U.S. Pat. No. 4,116,747 granted Sept. 26, 1978 to Paul H. Hamisch, Jr. and assigned to Monarch Marking Systems, Inc., except as explained hereinafter and as shown in the accompanying drawings. In general, the device 20 includes a frame 24 including a body 25 defining interior space 26. The body has a depending handle 27 to which a manually engageable actuator 28 is movably mounted. The actuator 28 includes a lever 29 pivotally mounted at the lower end portion of the handle 27. The lever 29 has a pair of laterally spaced aligned gear sectors 30 (only one of which is shown) which mesh with laterally space axially aligned gears 31 which in turn mesh with racks or straight gears 32 on a print head generally indicated at 33. Actuation of the actuator 28 causes movement of the actuator 28, the gears 31 and the print head 33 out of their initial or home positions shown in FIGS. 1, 3 and 7 to the actuated or printing position shown in FIG. 6. The print head 33 is illustrated as having two series or lines of printing bands 34 and respective selectors 35 for each line. The selectors 35 are used for changing the setting of any printing band 34 to a new selected position. If desired, print wheels can be used instead of the illustrated printing bands 34. The print head 33 has a frame or body 36 on which the printing bands 34 and the selectors 35 are mounted. The print head 33 is in turn mounted for sliding movement on a subframe generally indicated at 37 mounted within the interior space 26. The subframe 37 includes a pair of essentially mirror image subframe sections 38 and 39. The subframe sections 38 and 39 rotatably mount a toothed driver, specifically a feed wheel 40 having teeth 41, a platen 42 with which the print head 33 cooperates, a delaminator in the form of a peel roller 43, and annular members 44 for rotatably mounting the roll R. An applicator generally indicated at 45 in the form of an applicator roll 46 is rotatably mounted by the frame 24. The device 20 as described above is like the labeler disclosed in U.S. Pat. No. 4,116,747 incorporated herein by reference. The device 20 is modified with respect to the labeler of U.S. Pat. No. 4,116,747 in that a feed mechanism generally indicated at 47 is mounted to the print head 33 and in the a curved guide 48 is formed on the subframe 37.

Figures 3, 4, 5:
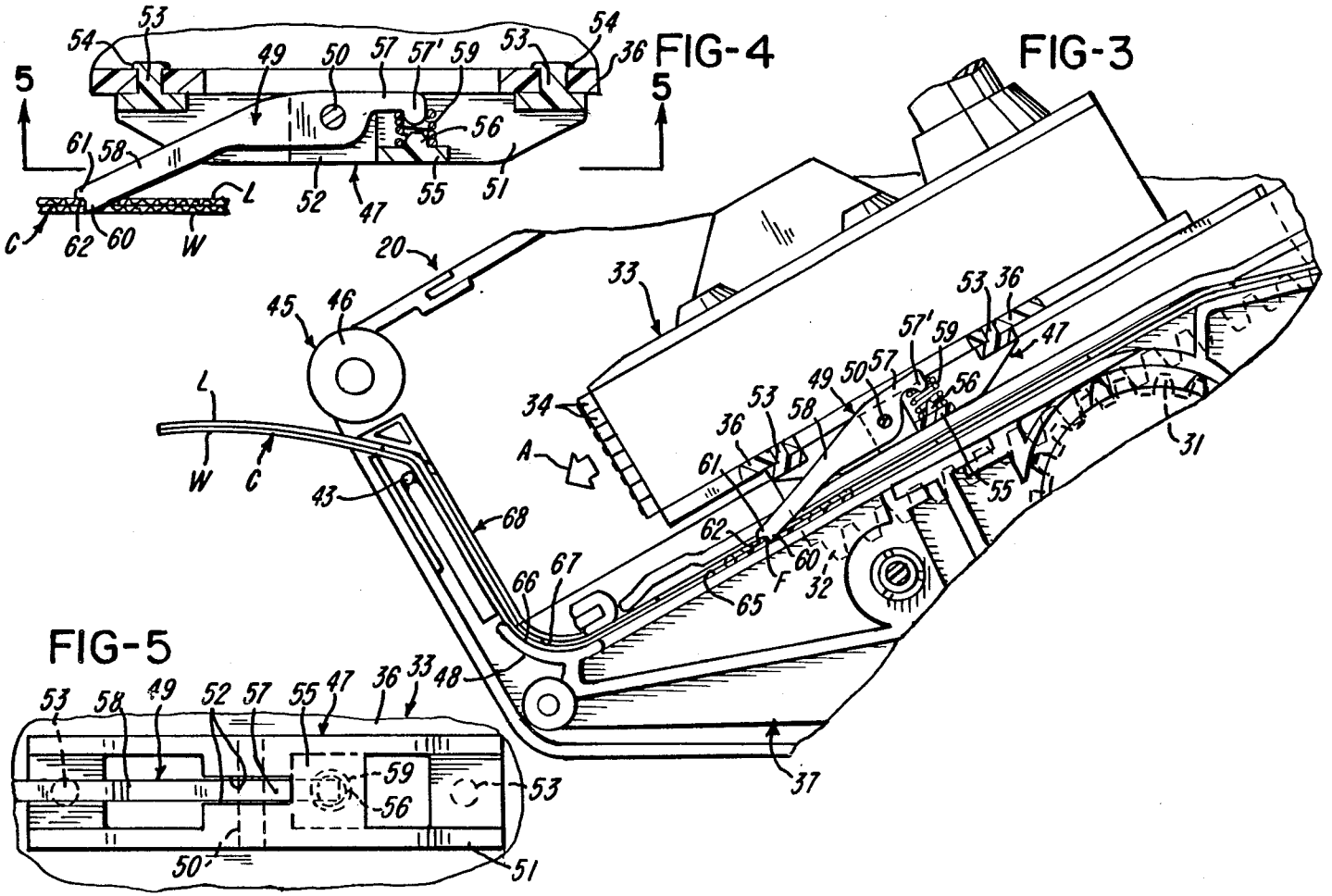
FIG. 3 is an enlarged side elevational view of a fragmentary portion of the labeler, with components shown slightly advanced from the home position with a feed finger engaged with a composite label web.
FIG. 4 is an enlarged sectional view of the feed finger and its mounting structure also shown in FIGS. 1 through 3.
FIG. 5 is generally a bottom view taken along line 5—5 of FIG. 4.

With reference to FIGS. 3 through 5, the feed mechanism 47 is shown to include a toothed driver, specifically a feed finger 49 pivotally mounted on a pivot or pin 50. The pin 50 is mounted in a mounting member 51 suitably secured to the print head frame 36. The mounting member 51 has a pair of spaced walls 52 between which the feed finger 49 is loosely guided for pivotal movement. The mounting member 51 includes a pair of studs 53, the ends of which are heat peened as shown at 54. The studs 53 can alternatively be snap connectors, if desired. The mounting member 51 also includes a spring mounting block 55 having a projection 56. The feed finger 49 has two lever arms 57 and 58. A compression spring 59 receives a projection 57' on the lever arm 57 and the projection 56. The spring 59 urges the feed finger 49 counterclockwise as viewed in FIGS. 3 and 4, for example, into contact with the composite web C. The lever arm 58 of the feed finger 49 includes a tooth 60 for engaging a feed hole F in the composite web C and a projection 61 having a land 62 for contacting the upper surface of the label L.

Figure 2:
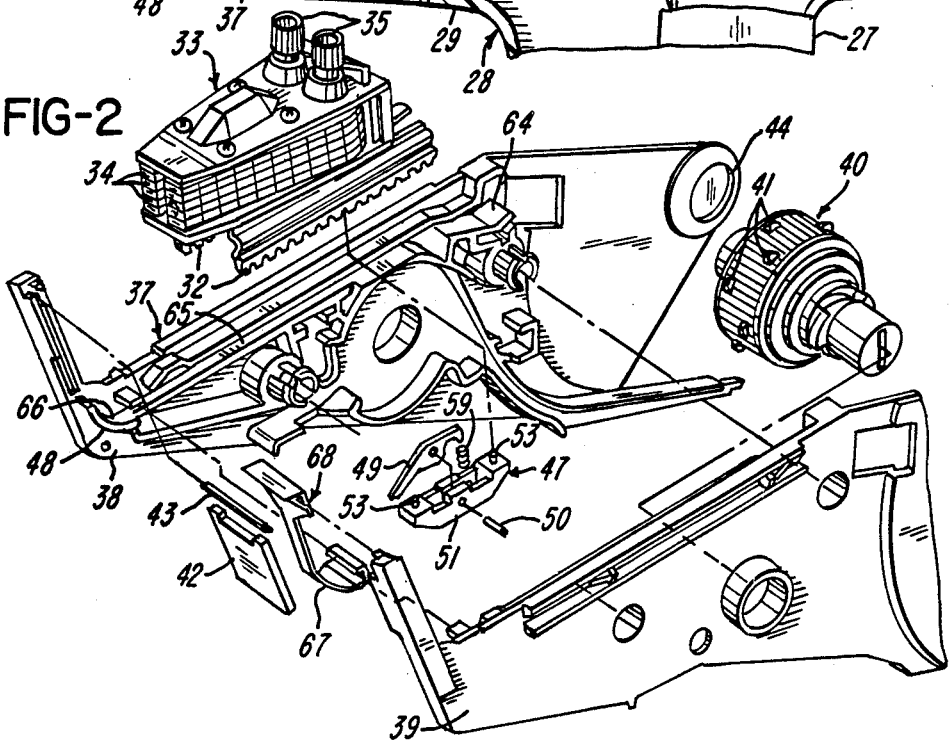
FIG. 2 is a fragmentary exploded perspective view of the labeler.
Figure 6:
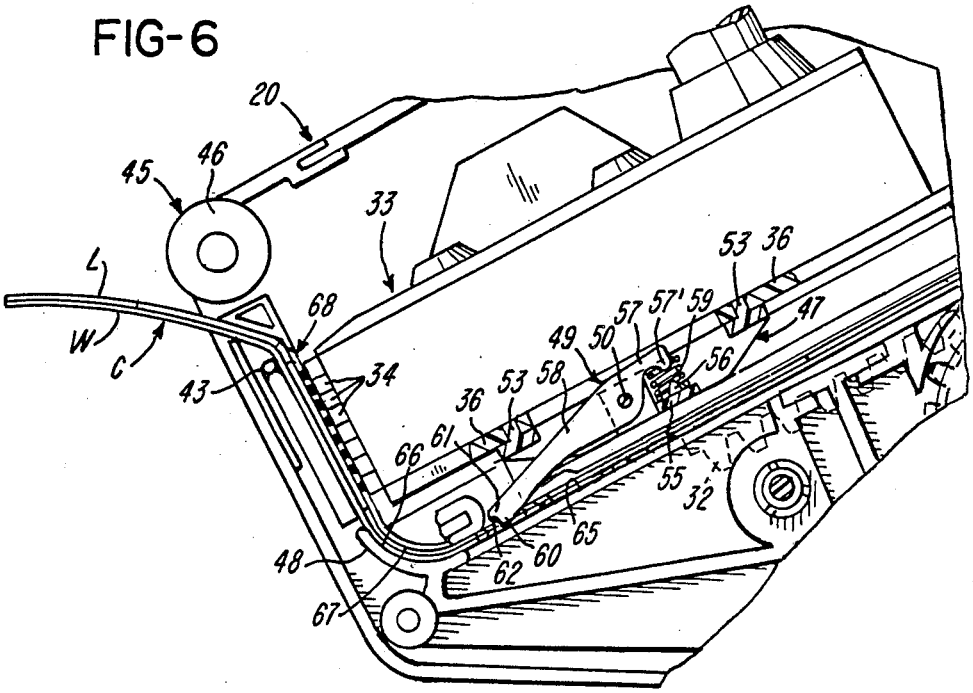
FIG. 6 is a fragmentary view similar to FIG. 3, but showing components in the printing position.

As the print head 33 moves in the direction of the arrow A from the home position to the printing position shown in FIG. 6, the print head 33 moves the feed finger 49. After the feed finger 49 has traveled a short distance in the direction of arrow A, the tooth 60 encounters a feed hold F to advance the composite web W through a pitch or pitch distance p equal to the length of one label L in FIG. 8, two labels L1 and L2 in FIG. 9, and two labels L3 and L4 in FIG. 10. As the label or labels to be printed upon arrive at the printing position between the print head 33 and the platen 42, the printing bands 34 make printing contact with that label. When the actuator 28 is returned to its home position by the action of a return spring (not shown), the print head 33 and the feeding mechanism 37 which it carries are returned to their home positions. In so doing, the tooth 60, which is lightly biased into contact with the label, rides on the upper surface of the label. As the print head 33 approaches its home position, the tooth 60 passes the feed hole F. When the print head 33 reaches the home position, the tooth 60 of the feed finger 49 rests on a label slightly upstream of that feed hole F. It is apparent that each complete actuation of the actuator 28 causes the composite web C to be fed through the pitch distance p by the feed finger 49 and release of the actuator 28 causes the feed finger 49 to return to its initial position where it is ready to again feed the composite web C during the next cycle of operation. As is apparent, the device 20 is adapted to print and dispense labels L while the labels L are still releasably adhered to the carrier web W. With this arrangement the composite web C is threaded through the device in such a path that it is paid out of the roll R and passes between brake roll 63 and a back-up member 64 (FIGS. 1 and 2) on the subframe 37. From there the composite web C passes along and is supported by a surface 65 in the subframe 37. The surface 65 merges smoothly with a curved surface 66 on the member 48. Thus, the composite web C is guided by the surface 66 and passes between the surface 66 and a surface 67 of a guide and hold-down member 68. The composite web C exits as shown in FIGS. 1, 3, 6 and 7. Once the composite web C has been dispensed, the labels can be manually peeled from the carrier web W.

Figure 7:
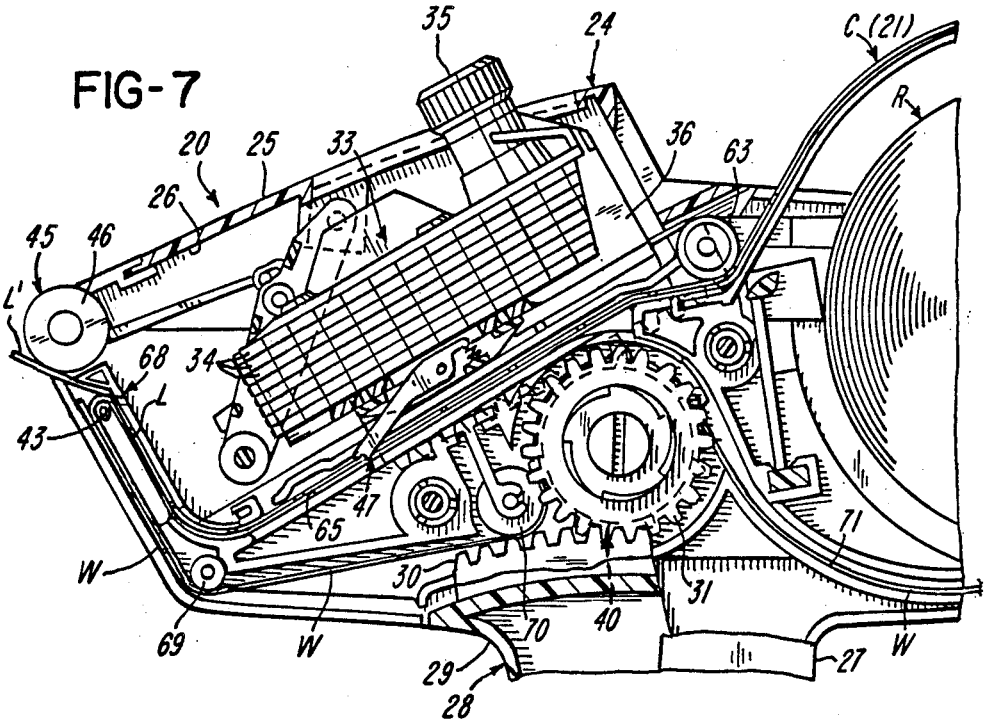
FIG. 7 is a view similar to FIG. 1, but showing the labeler threaded so as to delaminate labels from the carrier web.

In that the device 20 has the same feeding mechanism, namely the feed wheel and pawl and ratchet drive as in U.S. Pat. No. 4,116,747, incorporated herein by reference, the device 20 is also able to feed, delaminate and apply labels in the conventional manner using the toothed feed wheel 40. In that event the carrier web W is passed, as shown in FIG. 7, partially about the delaminator 43 where the leading label L' is delaminated. From there the carrier web W is passed partially about a guide roller 69 and from there to between the feed wheel 40 and a back-up roller 70. From there the carrier web W passes along a track 71 and exits the device to the right of the handle 27 as shown in FIG. 7. Thus, the device 20 is useable either to simply print and dispense labels on a carrier web W or to print and apply labels.

Figure 8:
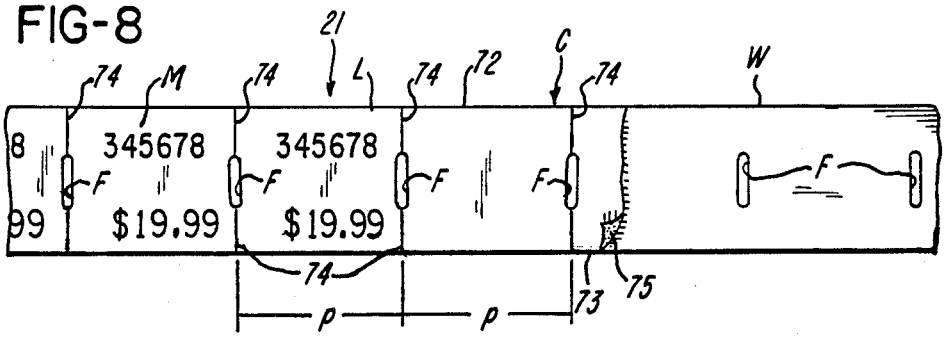
FIG. 8 is a top plan view of a composite label web for use in the labeler.

Referring now to FIG. 8, there is disclosed the composite label web 21 with its feed holes F which extend through both the label material M and the carrier web W at equally longitudinally spaced intervals. The label material M and the carrier web W are coextensive in width as shown and have straight spaced side edges 72 and 73. The label material M is completely severed transversely at equally longitudinally spaced apart intervals by lines of complete severing 74 extending between and to the side edges 72 and 73. The complete severing 74 does not extend into the carrier web. The complete severing 74 is aligned with the respective feed holes F. The feed holes F are elongate and extend in the transverse direction. The underside of the label material M has a coating of pressure sensitive adhesive 75. The adhesive 75 adheres the labels lightly to a release coating on the surface of the carrier web W. If desired, the adhesive 75 can be patterned as disclosed in prior art U.S. Pat. No. 4,214,024 granted July 22, 1980 to David N. Jacobson and assigned to Monarch Marking Systems, Inc. The feed finger 49 feeds the composite web by engagement with successive feed holes or feed cuts F.

Figure 9:
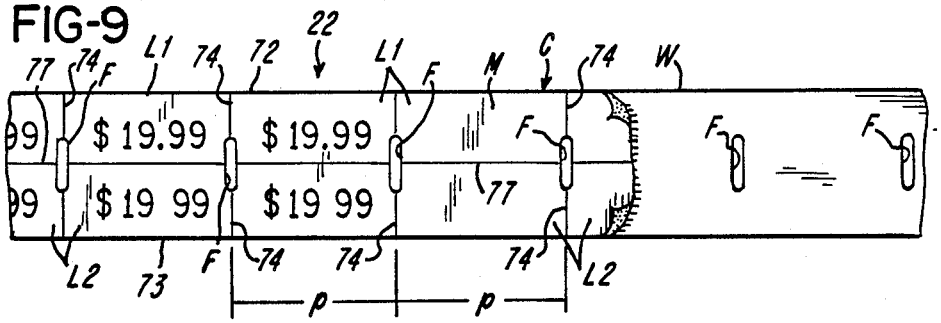
FIG. 9 is a top plan view of an improved composite label web.

The composite web 22 shown in FIG. 9 is the same as the composite web 21 except as indicated hereinafter and therefore the same reference characters are used where possible. The composite web 22 has a longitudinally extending line of complete severing 77 in the label material M. The complete severing 77 is shown to intersect the feed holes and is preferably halfway or centrally between the side edges 72 and 73. Thus, instead of there being one label between each adjacent pair of adjacent transverse lines of complete severing 74 as in the composite web 21, there are two labels L1 and L2. As shown, the complete severing 77 does not extend into the carrier web W. Using the two-line print head 33, two small labels L1 and L2 can be printed simultaneously for each actuation of the actuator 28.

The invention also includes method of using labels by providing a composite label web 22 having a longitudinally extending carrier web W, a longudinally extending label material web M releaseably adhered to the carrier web W, equally longitudinally spaced transverse lines of complete severing 74 separating the label material web into a longitudinally extending series of labels, wherein the label material web has spaced side edges 72 and 73, a single longitudinally extending line of complete severing 77 preferably disposed halfway or centrally between the side edges 72 and 73 for further severing the label material web M to provide a pair of transversely adjacent labels L1 and L2, and longitudinally spaced feed cuts F in the carrier web W adapted to be engaged by a toothed driver 49; simultaneously printing on the two transversely adjacent labels L1 and L2; and advancing the composite web 22 stepwise using the feed cuts F.

Figure 10:
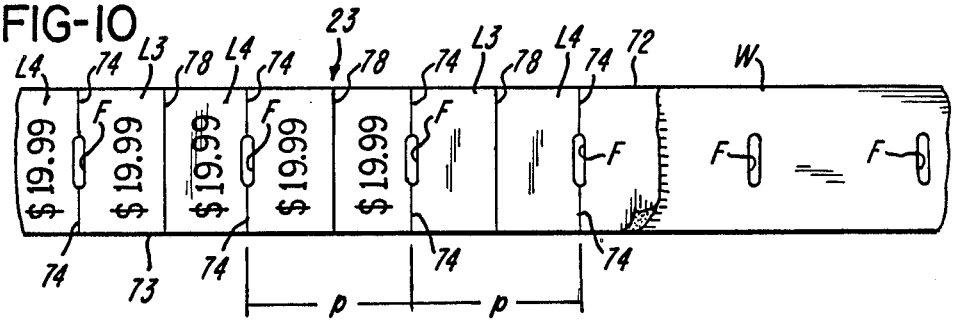
FIG. 10 is a top plan view of another improved composite label web.

The composite web 23 shown in FIG. 10 is the same as the composite web 21 except as indicted hereinafter and therefore the same reference characters are used where possible. The composite web 23 has transversely or laterally extending lines of complete severing 78 extending from the side edge 72 to the side edge 73 between each pair of adjacent lines of complete severing 74. Preferably the complete severing 78 is disposed midway or centrally between the complete severing 74. The complete severing 78 does not extend into the carrier web W. Using a two-line print head which is turned 90° from the print head 33, two small labels L3 and L4 can be printed simultaneously for each actuation of the actuator 28. As shown, the feed holes F are spaced apart longitudinally by a distance equal to a multiple, e.g., twice the distance between adjacent lines of complete severing 74 and 78. If desired the multiple can be three or more in which case there would be three or more labels per pair of adjacent feed holes.

The invention also includes method of using labels by providing a composite label web 23 having a longitudinally extending series of sets of pressure sensitive labels L3, L4, etc. releasably adhered to the carrier web W, the labels being completely severed from each other by lines of complete severing at equally longitudinally spaced transversely extending lines of complete severing 74 and 78, feed cuts F in the carrier web W engageable by a toothed driver 49, and wherein the feed cuts F are spaced longitudinally by multiples of the distance between adjacent lines of complete severing, wherein the multiple is a numeral of two or greater; simultaneously printing on the sets of labels; and advancing the composite web 23 stepwise through a distance equal to the multiple times the label length.

Other embodiments and modifications of the invention will suggest themselves to those skilled in the art, and all such of these as come within the spirit of this invention are included within its scope as best defined by the appended claims.

I claim:

1. A hand-held device, comprising: a frame having a handle, means for rotatably supporting a label roll of a composite web having labels releasably secured to a carrier web, a platen mounted by the frame, a print head mounted for movement into and out of printing cooperation with a label and the platen at a printing zone, first advancing means engageable with the composite web upstream of the printing zone for advancing the composite web from the roll to the printing position, means disposed adjacent the printing zone for delaminating printed labels, a label applicator disposed adjacent the delaminating means, second advancing means separate from and movable relative to the first advancing means and engageable with the carrier web downstream of the delaminating means for advancing the carrier web to move a label to the printing position and to delaminate a just printed label from the carrier web at the delaminating means, wherein the second advancing means is disposed out of the path of the composite web so that the second advancing means cannot engage the composite web in the path, an actuator disposed at the handle, means for drivingly coupling the actuator to the first advancing means and to the second advancing means, wherein the first advancing means includes a feed finger pivotally mounted on the print head and having a tooth adapted to engage directly with feed holes in the composite web, and whereby the device can optionally be used either to print labels and dispense the composite web from the device or to print labels and to delaminate and dispense labels to a position in underlying relationship to the label applicator.

2. A hand-held device, comprising: a frame having a handle, means for rotatably supporting a label roll of a composite web having labels releasably secured to a carrier web, a platen mounted by the frame, a print head mounted for movement into and out of printing cooperation with a label and the platen at a printing zone, first advancing means engageable with the composite web upstream of the printing zone for advancing the composite web from the roll to the printing position, means disposed adjacent the printing zone for delaminating printed labels, a label applicator disposed adjacent the delaminating means, second advancing means separate from and movable relative to the first advancing means and engageable with the carrier web downstream of the delaminating means for advancing the carrier web to move a label to the printing position and to delaminate a just printed label from the carrier web at the delaminating means, wherein the second advancing means is disposed out of the path of the composite web so that the second advancing means cannot engage the composite web in the path, an actuator disposed at the handle, means for drivingly coupling the actuator to the first advancing means and to the second advancing means, wherein the first advancing means includes a feed finger pivotally mounted on the print head and having a tooth adapted to engage directly with feed holes in the composite web, wherein the second advancing means includes a feed wheel disposed for feeding cooperation with the carrier web, and whereby the device can optionally be used either to print labels and dispense the composite web from the device or to print labels and to delaminate and dispense labels to a position in underlying relationship to the label applicator.

* * * * *